United States Patent [19]

Hams

[11] 4,201,378

[45] May 6, 1980

[54] SKEW DETECTOR

[75] Inventor: Kenneth A. Hams, Nazareth, Pa.

[73] Assignee: Bell & Howell Company, Phillipsburg, N.J.

[21] Appl. No.: 906,379

[22] Filed: May 16, 1978

[51] Int. Cl.[2] ..... B65H 7/08

[52] U.S. Cl. ..... 271/261; 250/561

[58] Field of Search ..... 271/261, 259; 250/548, 250/557, 561, 571, 578

[56] References Cited

U.S. PATENT DOCUMENTS

| | | | |
|---|---|---|---|
| 2,818,252 | 12/1957 | Nilsson | 271/261 |
| 3,131,931 | 5/1961 | Fechkowsky | 271/48 |
| 3,240,487 | 3/1963 | Templeton | 271/53 |
| 3,289,808 | 6/1965 | Simmons | 198/33 |
| 3,316,411 | 4/1967 | Linderman | 250/561 |
| 3,833,816 | 9/1974 | Emura | 250/561 |
| 3,866,053 | 2/1975 | Emura | 250/561 |
| 3,890,509 | 6/1975 | Maxey | 250/561 |

*Primary Examiner*—Richard A. Schacher
*Attorney, Agent, or Firm*—Griffin, Branigan & Butler

[57] ABSTRACT

This invention concerns a photoelectric skew detection system which checks the alignment of rectangular articles travelling on a conveyor. The mechanism comprises four phototransistors (1,2,3, and 4) arranged in a narrow rectangular pattern. Two lamps (8,9) are provided, each lamp illuminating only the two phototransistors forming corners for a narrow dimension of the rectangle. If a trailing edge (6*a*) of a given rectangular article (6) crosses either of the two forward phototransistors (3,4), both of the two rearward phototransistors (1 and 2) must be lit. If one is not lit, an electrical circuit generates an error signal. In this manner, the mechanism simultaneously detects both skew conditions and a faulty lamp.

7 Claims, 14 Drawing Figures

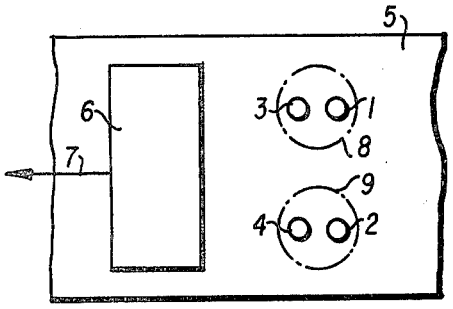
Fig. 1
Fig. 4A
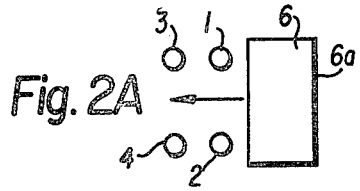
Fig. 2A
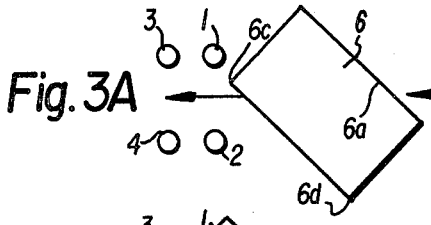
Fig. 3A
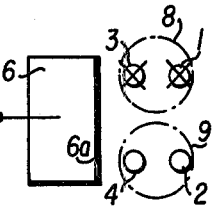
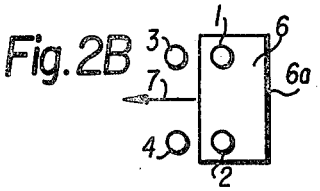
Fig. 2B
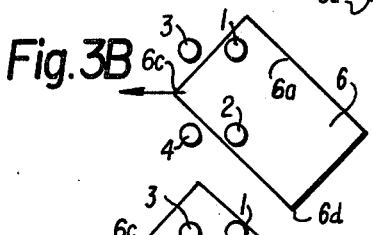
Fig. 3B
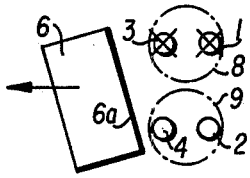
Fig. 4B
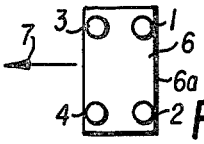
Fig. 2C
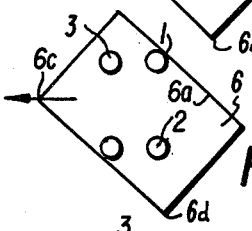
Fig. 3C
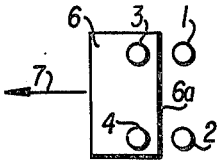
Fig. 2D
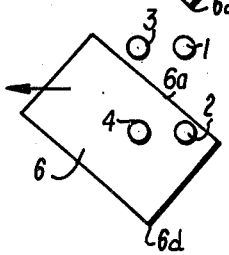
Fig. 3D
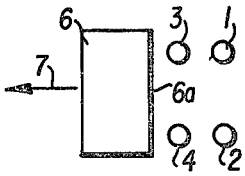
Fig. 2E
Fig. 5
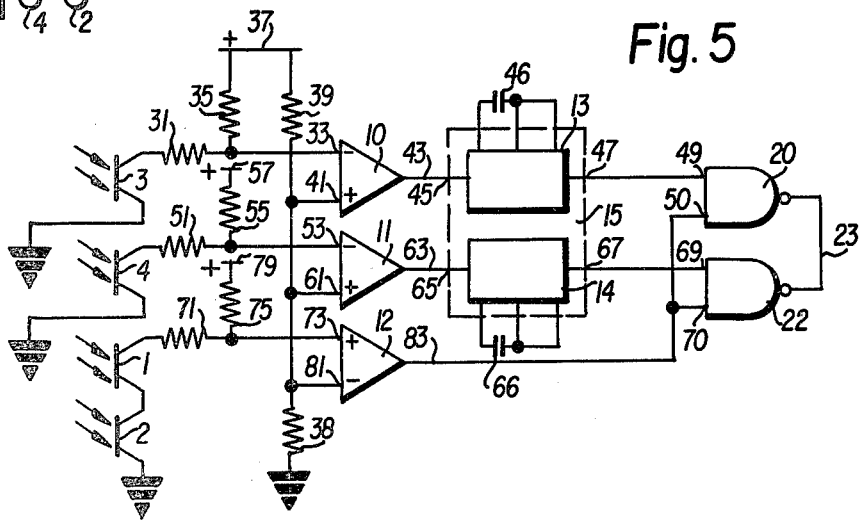

| | CIRCUIT ELEMENT OUTPUTS | | | | | | | | | | |
|---|---|---|---|---|---|---|---|---|---|---|---|
| FIGURE | 1 | 2 | 3 | 4 | 10 | 11 | 12 | 13 | 14 | 20 | 22 |
| 2A | 1 | 1 | 1 | 1 | 1 | 1 | 0 | 0 | 0 | 1 | 1 |
| 2B | 0 | 0 | 1 | 1 | 1 | 1 | 1 | 0 | 0 | 1 | 1 |
| 2C | 0 | 0 | 0 | 0 | 0 | 0 | 1 | 0 | 0 | 1 | 1 |
| 2D | 1 | 1 | 0 | 0 | 0 | 0 | 0 | 0 | 0 | 1 | 1 |
| 2E | 1 | 1 | 1 | 1 | 1 | 1 | 0 | 1 | 1 | 1 | 1 |
| 3A | 1 | 1 | 1 | 1 | 1 | 1 | 0 | 0 | 0 | 1 | 1 |
| 3B | 0 | 0 | 1 | 1 | 1 | 1 | 1 | 0 | 0 | 1 | 1 |
| 3C | 0 | 0 | 0 | 0 | 0 | 0 | 1 | 0 | 0 | 1 | 1 |
| 3D | 1 | 0 | 1 | 0 | 1 | 0 | 1 | 1 | 0 | 0 | 1 |
| 4A | 0 | 1 | 0 | 1 | 0 | 1 | 1 | 0 | 1 | 1 | 0 |
| 4B | 0 | 1 | 0 | 1 | 0 | 1 | 1 | 0 | 1 | 1 | 0 |

Fig. 6

SKEW DETECTOR

BACKGROUND OF THE INVENTION

In numerous contexts a skew or misaligned article traveling on a track or conveyor can be troublesome for downstream machinery. Sorters, stackers, trimmers, and encoders are just a few examples of downstream machinery conventionally designed to accept articles only in axial alignment with the track. Restricted by this limitation, these devices are susceptible to erratic jamming precipitated by skewed articles. Unfortunately, jammed machinery necessitates inopportune down time and, in severe cases, costly repair.

A skew article can inflict damage not only to equipment, but to itself as well. Downstream machinery may "chew up" articles bent on skew suicidal courses down a conveyor. When destruction of nonfungible articles occurs, it can be difficult to ascertain the unique features of the obliterated articles and, consequently, to replace them in natural sequence.

Several skew detection systems attempting to avert the above consequences are currently available. Some of these systems are photoelectric. For example, U.S. Pat. No. 3,131,931 to Fechkowsky discloses a system which, in several locations, used two photoelectric cells to test whether a sheet is properly aligned with a registration bar. Thus, the registration bar itself forms a guide or standard for alignment and thereby impedes the travel of the sheet.

U.S. Pat. No. 3,240,487 to Templeton purports not to require conventional sheet registering bars or retractable sheet registering gates. Templeton employs a pair of horizontally spaced-apart photoelectric cells mounted on a guideway structure and illuminated by light beams. Unless the leading edge of a sheet blocks out both light beams, sheet registering rollers will reject the sheet. In this event, another roller repeatedly attempts to correctively realign the sheet. Importantly, when one of Templeton's light sources does prove faulty, a skewed sheet may pass through undetected. Thus, a disadvantage of the prior art is that when a light source malfunctions, a skew article may pass through undetected and proceed to jam machinery.

An envisioned exemplary but non-exclusive usage of this invention concerns document sorting and stacking, particularly mail sorting and stacking. Commonly assigned U.S. application Ser. No. 859,074 is illustrative of such an applicable environment. That particular system provides a document sorter which accepts coded location signals and automatically sorts the documents using a plurality of stackers. In such a system, a document which is in a skew position on an infeed conveyor causes complications at the stackers.

In light of the above problems, it is an object of this invention to provide a skew detection mechanism for checking both the alignment of articles traveling on a track or conveyor and the conditions of light sources.

It follows, therefore, that another object of this invention is to provide a skew detection mechanism which will not incorrectly indicate proper article alignment when a light source malfunctions.

Moreover it is an additional object of this invention to provide a skew detection mechanism which will reduce costly mechanical repairs and machinery down time caused by the jamming of skew articles in machinery.

SUMMARY OF THE INVENTION

This invention concerns a photoelectric skew detection system which checks the alignment of rectangular articles travelling on a conveyor. The mechanism comprises four phototransistors arranged in a narrow rectangular pattern. Two lamps are provided, each lamp illuminating only the two phototransistors forming corners for a narrow dimension of the rectangle. If a trailing edge of a given rectangular article crosses either of the two forward phototransistors, both of the two rearward phototransistors must be lit. If one is not lit, an electrical circuit generates an error signal. In this manner, the mechanism simultaneously detects both skew conditions and a faulty lamp.

BRIEF DESCRIPTION OF THE DRAWINGS

The foregoing and other objects, features and advantages of the invention will be apparent from the following more particular description of preferred embodiments as illustrated in the accompanying diagrams in which like referenced characters refer to the same parts throughout the various views. The drawings are not necessarily to scale, emphasis instead being placed upon illustrating the principles of the invention.

FIG. 1 is a schematic view of a skew detector of this invention showing relative positions of illuminators, illumination sensitive elements, and travel direction of a rectangular article.

FIG. 2A is schematic view showing the position of a correctly aligned article before arrival at the skew detector of FIG. 1.

FIG. 2B is a schematic view showing the position of a correctly aligned article after arrival at the skew detector of FIG. 1.

FIG. 2C is a schematic view showing the position of a correctly aligned article at its midpoint of travel through the skew detector of FIG. 1.

FIG. 2D is a schematic view showing the position of a correctly aligned article before departure from the skew detector of FIG. 1.

FIG. 2E is a schematic view showing the position of a correctly aligned article after departure from the skew detector of FIG. 1.

FIG. 3A is a schematic view showing the position of a misaligned or skewed article before arrival at the skew detector of FIG. 1.

FIG. 3B is a schematic view showing the position of the article depicted in FIG. 3A after arrival at the skew detector of FIG. 1.

FIG. 3C is a schematic view showing the position of the article depicted in FIG. 3A at the midpoint of travel through the skew detector of FIG. 1.

FIG. 3D is a schematic view showing the position of the article depicted in FIG. 3A before departure from the skew detector of FIG. 1.

FIG. 4A is a schematic view showing the detector of faulty illumination means after a correctly aligned article has passed through the skew detector of FIG. 1.

FIG. 4B is a schematic view showing the detection of faulty illumination means after a misaligned or skewed article has passed through the skew detector of FIG. 1.

FIG. 5 is a partially schematic, partially block diagram depicting an electricaal circuit coupled to the illumination sensitive elements of FIG. 1 for generating an error signal when skewness or faulty lamps exist.

FIG. 6 is a chart indicating electrical signals assigned to or generated by given circuit components for the article positions indicated in FIGS. 2A through 2E, inclusive; 3A through 3D inclusive; and 4A through 4B inclusive.

DESCRIPTION OF PREFERRED EMBODIMENT

FIG. 1 depicts a skew detector system having four illumination sensitive elements, in this case phototransistors 1, 2, 3 and 4, arranged in a narrow rectangular pattern. The phototransistors are mounted proximate an article path 5 along which articles are transported by a conveyor (not shown). A rectangular article 6 (an envelope) moves along article path 5 in the direction indicated by an arrow 7. With respect to the direction of travel of articles along the article path 5, it can be seen that phototransistors 1 and 2 comprise a rearward pair of illumination sensitive elements and phototransistors 3 and 4 comprise a forward pair of illumination sensitive elements.

Phototransistors 1, 2, 3 and 4 are situated such that each phototransistor conducts an electrical current when illuminated by illumination means such as lamps 8 and 9. Lamp 8 illuminates only phototransistors 1 and 3 while lamp 9 illuminates only phototransistors 2 and 4. The lamps 8 and 9 are positioned on one side of the article path 5 and the phototransistors 1, 2, 3, and 4 are positioned on the other such that articles moving along the article path 5 interrupt the phototransistors.

Physical constraints of the conveyor 5 preclude the rectangular article 6 from traveling along the article path 5 without covering both phototransistor pairs, 1,3 and 2,4. That is, the width dimension of the article path 5 is not so broad that an article could pass under only one lamp 8 or 9 when its major axis is transverse to the direction of travel. In this respect, most conventional conveyors have drive pins, aligning brushes or the like to partially correct gross skewness which might result, for example, when a very long but narrow rectangular article travels down the conveyor with its major axis parallel to the direction of travel of the conveyor. This system also includes such a device, however, it is not shown for the sake of simplicity.

Since the type of conveyor used in conjunction with the skew detector system has no bearing on the uniqueness or function of this invention, none is specifically disclosed herein. However, it is mentioned in passing that in one embodiment the conveyor comprises a web having appropriate slits through which a light may pass from the lampe 8 and 9 to the phototransistors 1,2,3 and 4. On the other hand, in another mode the conveyor consists of a series of spaced-apart rollers. Furthermore, the skew detector mechanism may itself comprise a stationary stage interposed between two separate segments of either of the above-described types of conveyors such that the momentum of a first conveyor propels the article over the skew detector mechanism stage and onto a second conveyor which completes the course of travel should no error signal result. Conceivably, a transparent conveyor could also be employed in conjunction with this invention, as could endless chains having usher pins attached thereto.

FIG. 5 depicts an electrical circuit employed in the skew detector system of FIG. 1 to generate an error signal when skewness or faulty lamps exist. Shown in FIG. 5 are the four phototransistors 1, 2, 3, and 4; three separate and unique comparators, (operational amplifiers) 10, 11, and 12; a pulse-timer 15 (which includes two one-shot multivibrators 13 and 14); NAND gates 20 and 22; and, an output terminal 23.

The collector of phototransistor 3 is connected to resistor 31 which is in turn connected to an inverting input terminal 33 of the operational amplifier 10. A resistor 35 is connected between a positive voltage source 37 and the terminal 33. Resistors 38 and 39, preferably chosed to be of the same value, form a voltage division network between voltage source 37 and ground to produce a reference potential at a noninverting input terminal 41 of the amplifier 10.

The output from the operational amplifier 10, as taken at terminal 43, is applied to an input terminal 45 of the one-shot multivibrator 13.

The output from the one-shot multivibrator 13 is taken at terminal 47 and applied to an input terminal 49 of the NAND gate 20. Input terminal 50 of NAND gate 20 is energized from operational amplifier 12.

The collector of phototransistor 4 is connected through a resistor 51 to an inverting input terminal 53 of the operational amplifier 11. Resistor 55 connects a positive voltage source 57 with the inverting input terminal 53. In like manner as above described, the voltage division network established by resistors 38 and 39 provides a reference potential input to a non-inverting input terminal 61 of the operational amplifier 11.

The output of operational amplifier 11 is taken at terminal 63 and applied to an input 65 of the one-shot multivibrator 14. An output signal from the one-shot multivibrator 14 is taken at terminal 67 and applied to an input terminal 69 of the NAND gate 22. Input terminal 70 of the NAND gate 22 is energized from the operational amplifier 12. The output of NAND gates 20 and 22 are connected at terminal 23 to produce an error, or skew, signal thereon. In this respect, a low (0) signal produced at the terminal 23 indicates the presence of a skew article while a high (1) signal at the terminal 23 indicates that a skew article is not present.

The phototransitors 1 and 2 are connected in series such that the collector of phototransistor 2 is connected to the emitter of phototransistor 1. The collector of phototransistor 1 is connected through a resisotr 71 to a non-inverting input terminal 73 of the operational amplifier 12. A resistor 75 connects a positive voltage source 79 with resistor 71. An inverting input terminal 81 of the operational amplifier 12 is biased by the reference potential created by the voltage division network comprising resistors 38 and 39 as hereinbefore described. The output of operational amplifier 12 is taken at terminal 83 and applied to the input terminal 50 of NAND gate 20 and the input terminal 70 of NAND gate 22.

Although many combinations of resistors can achieve the operation as previously detailed, some sample values follows:

resistor 38 = resistor 39 = 10K
resistor 35 = resistor 55 = resistor = 27K
resistor 31 = resistor 51 = resistor 71 = 6.8K With regard to operation of the individual elements, operational amplifiers 10, 11, and 12 respectively produce low (0), or zero, signals when the voltages applied to the inverting inputs 33, 53, and 81 exceed the potentials applied to the non-inverting inputs 41, 61, and 73. On the other hand, when the non-inverting inputs 41, 61, and 73 are greater, high (1), or positive, signals are respectively produced by the amplifiers 10, 11, and 12. In the cases of the amplifiers 10 and 11, the voltages at the inverting inputs 33 and 53 are less than the reference voltages at the non-inverting inputs 41 and 61 respectively when their phototransistors 3 and 4 are illuminated such that the amplifiers 10 and 11 produce high (1) output signals. In the case of the amplifier 12, the potential applied to the inverting input 81 is less than the potential applied to the non-inverting input 73 when neither phototransistors 1 nor 2 are illuminated, to produce a high (1) output signal.

The one-shot multivibrator 13 and the one-shot multivibrator 14 are essentially pulse-timers for triggering high or positive pulses of a predetermined but adjustable widths when their inputs change from low to high signals. Input-signal changes from high to low signals or continuations of either high or low signals do not effect the multivibrators 13 and 14. The pulse width of the signals triggered by the multivibrators 13 and 14 are dependent upon the value of capacitors 46 and 66 associated therewith.

Concentrating now on the operation of the skew detector, FIGS. 2A, 2B, 2C, 2D, and 2E constitute a series of frames portraying the passage of a correctly aligned rectangular article 6 through the skew detection system of FIG. 1. In each frame the arrow 7 associated with rectangular article 6 indicates the direction of travel of article 6 and of the conveyor. As above described, the article 6 first encounters a rearward pair of phototransistors 1 and 2 and subsequently a forward pair of phototransistors 3 and 4. Thus, when viewing the figures, the article 6 moves from right to left. Broadly according to the design of the invention, as described above, an error signal is generated when a trailing edge **6*a* crosses either but not both of the two forward phototransistors 3 and 4 and either or both of the two rearward phototransistors 1 and 2** are not illuminated.

FIG. 6 is a chart correlating the electrical signals for various circuit elements of FIG. 5 for the series of frames depicted in FIGS. 2A through 2E inclusive, 3A through 3D inclusive, 4A, and 4B. In reading the chart with respect to the phototransistors (circuit elements 1, 2, 3, and 4) a high (1) signal is assigned to a phototransistor when the phototransistor is exposed and conducting. Otherwise, the phototransistor value is low (0).

To expalin the operation of the FIG. 5 embodiment, with reference to FIG. 6, a discussion of skew detection as represented in FIGS. 3A through 3D inclusive ensues. Initially (FIG. 3A) all phototransistors 1–4 are illuminated and conducting. This means that the signals at the non-inverting input terminals 41 and 61 of amplifiers 10 and 11 are exceeding the respective signals at the inverting input terminals 33 and 53, thereby producing high signals at the input terminals 45 and 65 of the one-shot multivibrators 13 and 14. In this fully-illuminated mode the signal at the inverting input terminal 81 of the amplifier 12 exceeds the signal at the nonn-inverting input terminal 73 so that a low signal is produced at input terminals 50 and 70 of the NAND gates 20 and 22. Assuming that phototransistors 3 and 4 have been continuously illuminated for at least some time greater than the width of the last pulse generated by the respective one-shot multivibrators 13 and 14, multivibrators 13 and 14 have resumed a low signal and are not triggered in this case by either amplifier 10 or 11 since neither amplifier is switching from a low to a high signal. Therefore, the one-shot multivibrators 13 and 14, as well as the amplifier 12, supply low signals to NAND gates 20 and 22. Both NAND gates 20 and 22 then generate high signals indicating an error-free condition.

With reference to FIG. 3B, rearward phototransistors 1 and 2 are covered by a skew article while forward phototransistors 3 and 4 are exposed and are conducting. Since the conductivity of phototransistors 3 and 4 is unchanged, the respective outputs from the one-shot multivibrators 13 and 14 remain low. The nonconductivity of phototransistors 1 and 2 prompts a high signal from amplifier 12. However, the NAND gates 20 and 22, receiving high and low signals, still generate high signals.

In FIG. 3C all phototransistors are covered. As above described, amplifier 12 is now supplying a high signal. Amplifiers 10 and 11 now switch to a low signal but, since only a switch from a low to a high triggers the one-shot multivibrators 13 and 14, the signals from these elements remain low. Hence, the NAND gate outputs are still high, indicating an errorfree condition.

In FIG. 3D phototransistors 1 and 3 are exposed and conducting while phototransistors 2 and 4 are nonconducting. Since phototransistors 1 and 2 are in series, the signal appearing at the non-inverting input terminal 73 of amplifier 12 exceeds the signal at the inverting input terminal 81 and thereby produces a high signal at the input terminals 50 and 70 of the NAND gates 20 and 22. Since phototransistor 3 has just been illuminated, the operational amplifier 10 now has a signal at its non-inverting input terminal 41 which exceeds the input at its inverting input terminal 33 to cause a switch in its output signal to the one shot multivibrator from a low signal to a high signal. This switch from low to high triggers a pulse from oneshot multivibrator 13 which is applied to NAND gate 20. The NAND gate 20 is also receiving a high pulse from amplifier 12. In this configuration NAND gate 20 produces a low signal on terminal 23 which indicates the presence of a skew article 6.

It should be noted that FIG. 3D is not the only skew orientation possible to generate an error, or skew, signal. For example, if the article 6 is rotated such that a corner **6*d* precedes corner 6*c* in transit down the conveyor, phototransistors 2 and 4 become exposed and conducting while phototransistors 1 and 3 remain nonconducting. The output signal of operational amplifier 11 goes high and triggers the one-shot multivibrator 14 in an analogous fashion to one-shot 13 above, yielding a high signal to NAND gate 22. Thus, NAND gate 22 produces a low signal which results in output terminal 23** indicating a skew condition.

FIG. 4B illustrates how the skew detector produces an error, or skew, signal when one of the lamps 8 or 9 is faulty. In FIG. 4B lamp 8 is indicated as faulty so that phototransistors 1 and 3 are not conducting although exposed. The operaion of the electrical circuit of FIG. 5 for this particular configuration is identical to that described with reference to FIG. 3D, i.e., a skew article covering phototransistors 1 and 3; thus an error signal is produced as was described above.

Not only does the skew detector indicate error when one of the lamps is faulty, but it also indicates error when either of the rearward phototransistors 1 and 2 malfunctions.

While the invention has been particularly shown and described with reference to preferred embodiments thereof, it will be understood by those skilled in the art that various alterations in form and detail may be made therein without departing from the spirit and scope of the invention.

I claim:

1. A photoelectric skew detection system for monitoring the misalignment of rectangular articles travelling on a track and the condition of illumination elements in said system, said system comprising:

four illumination sensitive elements arranged on one side of said track in an elongated rectangular pattern, said pattern having an axis of elongation substantially normal to the direction of article travel, said first and second of said elements forming an upstream pair of illumination sensitive elements positioned on the upstream side of said elongated rectangular pattern, and said third and fourth elements forming a downstream pair of illumination sensitive elements positioned on the downstream side of said pattern, said elements being arranged so that said first and third elements are adjacent on the perimeter of said rectangular pattern and said second and fourth elements are adjacent on the perimeter of said rectangular pattern, each of said elements producing a change in electrical activity when illuminated;

two illumination means, the first illuminating means illuminating said first and third illumination sensitive elements, and the second illumination means illuminating said second and fourth illumination sensitive elements, said illumination means being positioned on th other side of said track from said illumination sensitive elements so that articles traveling on said track can block illumination from said illumination means; and, an electrical circuit means connected to said illumination sensitive elements for generating an error signal in response to changes in the electrical activity of said illumination sensitive elements when a trailing edge of a rectangular article traveling on said track unblocks at least one of said downstream pair of elements while one of said upstream illumination sensitive elements is still blocked.

2. The system as in claim 1 wherein the electrical circuit means comprises:

a first comparator means responsive to an electrical input signal received from said first and second illumination sensitive elements connected in series, said first comparator means comparing the input signal from said first and second illumination sensitive elements 1 and 2 to a reference signal and generating an output signal in response to a predetermined difference between said input and reference signals;

a second comparator means responsive to an electrical input signal received from said third illumination sensitive element, said second comparator means comparing theinput signal from said third illumination element to a reference signal and generating output signals in response to predetermined differences between said input and reference signals;

a third comparator means responsive to an electrical input signal received from said fourth illumination sensitive element, said second comparator means comparing the input signal from said fourth illumination element to a reference signal and generating signals in response to predetermined differences between said input and reference signals;

a pulse-timing means coupled to said second and third comparator means for producing separate electrical pulses in response to said output signals from said second and third comparitor means respectively;

a first gate means coupled to said pulse-timing means and said first comparator means for producing an error indicative signal as a function of the output signal of said first comparator means and pulses that were triggered by the second comparator means; and, a second gate means coupled to said pulse-timing means and said first comparator means for producing an error indicative signal as a function of the output signal of said first comparator means and pulses that were triggered by the third comparator means.

3. The system as in claim 2 wherein, the second comparator means comprises an operational amplifier having an inverting input terminal connected to the third illumination sensitive element and a non-inverting input terminal connected to a reference input signal;

the third comparator means comprises an operational amplifier having an inverting input terminal connected to the fourth illumination sensitive element and a non-inverting input terminal connected to a reference input signal; and, the first comparator means comprises an operational amplifier having a non-inverting input terminal connected in series to the first and second illumination sensitive elements, and an inverting input terminal connected to a reference input signal.

4. The system as in claim 2 wherein the pulse-timing means comprise one-shot multi-vibrators.

5. The system as in claim 2 wherein a first and second gate means comprise NAND gates.

6. The system as in claim 1, wherein the illumination sensitive elements are phototransistors.

7. A method of detecting skew, rectangularly-shaped articles traveling on a track with an illumination detection system, and for also obtaining information about faulty illumination sources in said system, said method comprising the steps of:

arranging four illumination sensitive elements adjacent to said track, said pattern having an axis of elongation substantially normal to the direction of article travel on said track, said first and second elements comprising an upstream pair of illumination sensitive elements positioned on an upstream side of said elongated rectangular pattern, and said third and fourth elements forming a downstream pair of illumination sensitive elements positioned on a downstream side of said pattern, said elements being arranged so that said first and third elements are adjacent one another on the perimeter of said rectangular pattern and said second and fourth elements are adjacent one another along the perimeter of said rectangular pattern;

arranging a first illumination source for illuminating said first and third illumination sensitive elements and arranging a second illumination source for illuminating said second and fourth illumination sensitive elements, said illumination sources being positioned on the other side of said track from the illumination sensitive elements so that articles traveling on the track can block illumination from the illumination sources from said respective illumination sensitive elements;

passing rectangular articles between the illumination sources and said illumination sensitive elements; and, generating an error signal when a trailing edge of a rectangular article traveling on said track unblocks at least one of the downstream pair of elements while one of the upstream illumination sensitive elements is still unblocked.

* * * * *

UNITED STATES PATENT AND TRADEMARK OFFICE

CERTIFICATE OF CORRECTION

PATENT NO. : 4,201,378

DATED : May 6, 1980

INVENTOR(S) : Kenneth A. Hams

It is certified that error appears in the above-identified patent and that said Letters Patent are hereby corrected as shown below:

Column 2, line 64, change "electricaal" to -- electrical --.

Column 4, line 6, change "chosed" to -- chosen --.

Column 4, line 56, after "resistor" (third occurrence), add -- 75 --.

Column 5, line 44, change "expalin" to -- explain --.

Column 5, line 55, change "nonn-inverting" to -- non-inverting --.

Signed and Sealed this

*Twenty-eighth* Day of *October 1980*

[SEAL]

*Attest:*

SIDNEY A. DIAMOND

*Attesting Officer*

*Commissioner of Patents and Trademarks*